United States Patent [19]

Rakonjac

[11] Patent Number: 4,895,546

[45] Date of Patent: Jan. 23, 1990

[54] INFLATABLE TOY WITH INDEPENDENTLY MOVABLE LIMBS

[76] Inventor: Zoran Rakonjac, 214 N. Mayers, Burbank, Calif. 91506

[21] Appl. No.: 280,336

[22] Filed: Dec. 6, 1988

[51] Int. Cl.[4] ..... A63H 3/06

[52] U.S. Cl. ..... 446/221; 446/226

[58] Field of Search ..... 446/221, 222, 223, 224, 446/225, 226, 220

[56] References Cited

U.S. PATENT DOCUMENTS

| | | | |
|---|---|---|---|
| 1,634,189 | 6/1927 | Henry | 446/226 |
| 2,134,063 | 10/1938 | Turchanyi | 446/221 |
| 2,731,768 | 1/1956 | Harrowe | 446/226 |
| 3,065,566 | 11/1962 | Sugimoto | 446/221 |
| 4,770,412 | 9/1988 | Wolfe | 446/226 X |

FOREIGN PATENT DOCUMENTS

| | | | |
|---|---|---|---|
| 657031 | 2/1963 | Canada | 446/226 |
| 631077 | 10/1949 | United Kingdom | 446/223 |

*Primary Examiner*—Robert A. Hafer
*Assistant Examiner*—Sam Rimell
*Attorney, Agent, or Firm*—Erik M. Arnhem

[57] ABSTRACT

An inflatable three dimensional figure that simulates an animal or a human personage, e.g. a panda or a policeman. The limb sections (arms and legs) extend angularly from opposite ends of a flexible pipe (tube) that extends through a hollow sleeve formed on the torso section of the figure. The limbs can be angularly adjusted to different positions (raised, lowered, etc.). Angularl adjustment of the limbs causes the flexible pipe to twist within the hollow sleeve; frictional forces between the pipe and sleeve hold the limbs in adjusted positions.

2 Claims, 2 Drawing Sheets

INFLATABLE TOY WITH INDEPENDENTLY MOVABLE LIMBS

BACKGROUND OF THE INVENTION

This invention relates to an inflatable three dimensional figure, usable as a child's toy or amusement device. The three dimensional figure can be designed to simulate various different animals or personages, e.g. a dog, panda, bear, policeman, hockey player, etc. The inflatable figure is formed of paper-thin sheet plastic material, whose inflated shape is determined by the sheet pattern. Edge areas of the sheets are heat sealed or stamp welded to provide hollow balloon body structures.

The invention contemplates an improvement or variation of the inflatable balloon structure shown and described in U.S. Pat. No. 2,134,063. That patent shows a hollow three-dimensional body comprised of two sheets A that have edge areas thereof stamp welded together. Circular openings 1 and 2 are formed in the sheets to form spaces for insertional reception of a second inflatable body formed by sheets B. The second inflatable body includes a narrow mid section 10 adapted to be inserted into openings 1 and 2 of the main body (defined by sheets A).

In the patented arrangement discs *6a* and *7a* are located within the main balloon body to provide a sealed wall structure extending through the balloon body; each balloon body has its own inflation valve unit 11. The auxiliary inflatable body (formed by sheets B) simulates the limb areas of an animal. The patent disclosure indicates that mid section 10 of the ancillary body has a free fit within openings 1 or 2, such that the ancillary body can freely turn in the openings (see claim 6 of the patent).

SUMMARY OF THE INVENTION

My invention contemplates a three dimensional figure comprised of a main balloon body that simulates the trunk or body portion of an animal or person; a tubular wall extends within, and through, the main balloon body to frictionally receive the mid section of a hollow limb-forming body.

The contemplated construction involves an ancillary limb-forming body that includes a flexible pipe section extendable through the aforementioned tubular wall structure formed in the main balloon body. The outer surface of the flexible pipe section has extensive frictional contact with the tubular wall structure, such that the pipe section can be twisted around its axis and retained in its twisted position, i.e. the pipe section does not return to its untwisted position in the absence of manual force.

The contemplated structural arrangement enables the child to adjust the limbs (arms or legs) of the three dimensional figure. For example, a simulated human arm can be adjusted to an upwardly extending position, or a forwardly extending position, or a downwardly extending position. A simulated human leg can be adjusted to a position extending rearwardly from the simulated human body or forwardly from the simulated human body.

The principal object of the invention is to provide an inflatable balloon type figure, wherein simulated limb members can be swingably adjusted and retained in different positions relative to the main torso section of the inflatable figure. The invention provides an alternative to the structural arrangement of U.S. Pat. No. 2,134,063 wherein limb sections of the simulated figure are freely turnable, and hence not readily retained in adjusted positions.

THE DRAWINGS

FIG. 1 is a front elevational view of an inflated three dimensional figure embodying my invention.

FIGS. 2, 3, 4 and 5 are sectional views taken, respectively on lines 2—2, 3—3, 4—4 and 5—5 in FIG. 1.

FIG. 6 is a plan view of a flexible sheet pattern used to form the major component in the FIG. 1 assembly.

FIGS. 7, 8 and 9 are sectional views taken, respectively, on lines 7—7, 8—8 and 9—9 in FIG. 6.

FIG. 10 is a sectional view taken on line 10—10 in FIG. 6, with the flexible sheets turned inside out.

DESCRIPTION OF A PREFERRED EMBODIMENT OF THE INVENTION

Figure 1:
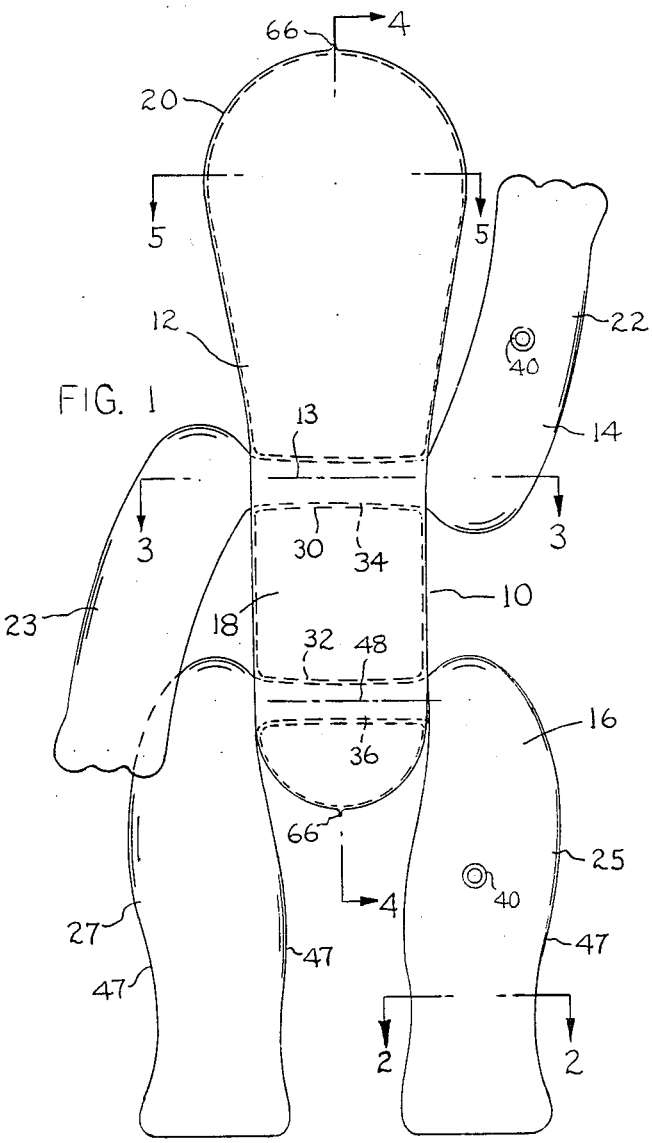
Figure 10:
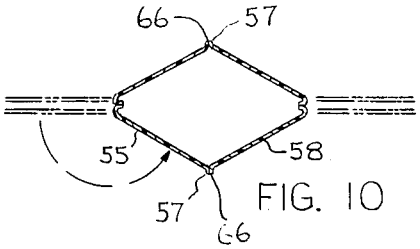

FIG. 1 shows a hollow inflated three dimensional FIG. 10 comprised of a main hollow body 12 and two anicillary hollow bodies 14 and 16. The three dimensional figure simulates a small human being of doll-like character. Hollow body 12 defines a simulated human torso section 18 and human head section 20. Hollow body 14 defines two simulated human arm sections 22 and 23, whereas hollow body 16 defines two simulated human leg sections 25 and 27.

Hollow body 12 is formed to include two tubular sleeve walls 30 and 32 extending transversely through the torso section 18. Hollow body 14 includes a flexible pipe section 34 extending through the tube (sleeve) defined by tubular sleeve wall 30.

Figure 3:
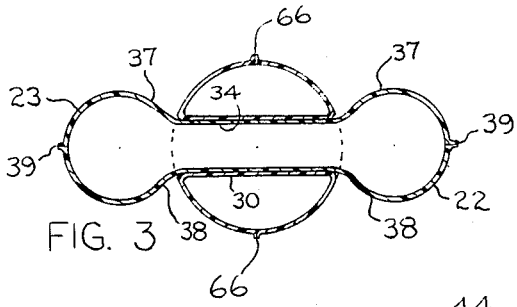
Figure 5:
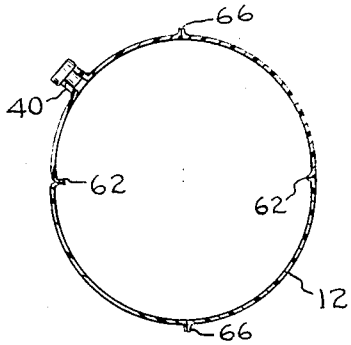
Figure 2:
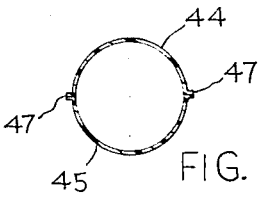

Each hollow body 14 or 16 is formed of two paper-thin plastic sheets having their peripheral edges sealed together to form a continuous edge seam around the respective hollow body. FIG. 3 illustrates the general cross-sectional character of hollow body 14, comprising two plastic sheets 37 and 38 having a continuous edge seam connection 39 (formed by heat and/or die pressure).

A conventional air-inflation tube 40 (FIG. 1) is suitably affixed to one of the plastic sheets for inflating the hollow body; a sealing plug (not shown) is associated with filler tube 40 to seal the pressurized air within body 14. Similar air-filler tubes are provided for the other two hollow bodies 12 and 16.

Hollow limb body 14 may be connected to the torso section of hollow body 12 before or after body 12 has been inflated, but prior to inflation of body 14. With limb body 14 in a deflated condition, the body can be manually passed through the tube defined by tubular wall 30, such that flexible pipe section 34 is positioned within tubular wall 30. Hollow body 14 can then be inflated to cause hollow limbs 22 and 23 to bulge to the condition shown in FIG. 1. The space within pipe section 34 and limbs 22 and 23 is one single air chamber; introduction of pressurized air into the chamber serves to inflate the pipe section and both limbs.

As seen in FIG. 1, hollow limb 22 extends upwardly from axis 13 of tubular pipe section 34. However, the normal unstressed condition of each limb 22 is downwardly.(as per limb 23). Limb 22 can be manually swung around axis 13 to assume the upraised position of FIG. 1. When limb 22 is swung around axis 13 the flexible pipe section 34 experiences a helical twisting motion. The outer surface of pipe section 34 remains in frictional contact with the inner surface of tubular sleeve wall 30. Therefore, after the manual force on limb 22 is released the limb remains in its upraised position. The limb can be returned to its normal lowered position, or any intermediate position, by suitable manual manipulation of the limb. Either limb 22 or 23 can be swingably manipulated around pipe axis 13 to assume various adjusted positions.

It should be noted that the space within hollow body 12 is pressurized. Therefore tubular sleeve 30 is pressurized on its inner surface, to thus exert a radial squeezing action on flexible pipe 34. Similarly the space within pipe 34 is pressurized to exert an expansion force on the inner surface of the pipe 34 wall. Thus, the air pressures within bodies 12 and 14 cause pipe 34 to have a fairly good frictional contact with the inner surface of sleeve 30. The length of sleeve 30 is also helpful in providing a fairly large sleeve-pipe surface contact area; in a typical construction sleeve 30 has a length of about four or five inches. The sleeve and flexible pipe are in frictional contact along the entire length of the sleeve. All of these factors cooperate to ensure that limb 22 or 23 is capable of being adjusted and retained in any desired position of adjustment around axis 13.

Hollow body 16 is structurally similar to hollow body 14. Body 16 comprises two plastic sheets 44 and 45 having a continuous edge seam connection 47. Flexible pipe section 36 of body 16 is positionable within the associated sleeve 32 of hollow body 12, such that either limb 25 or 27 can be swingably adjusted around pipe axis 48, to assume different adjusted positions extending forwardly from, or rearwardly from, torso 18. During such adjusting actions flexible pipe wall 36 is subjected to a twisting force, or an untwisting force, depending on the direction of adjustment.

Each sleeve 30 or 32 is preferably formed as an integral part of the wall structure that defines the outline shape of body 12. FIGS. 6 through 10 illustrate the body 12 sheet material in a partially assembled (fabricated) stage. Two paper-thin plastic sheets 50 and 52 are cut to the outline shape shown in FIG. 6. The sheet thickness is exaggerated in the drawings.

Each sheet 50 or 52 has a longitudinal axis 53 and a transverse axis 54. The individual sheets comprise two longitudinally extending major sheet sections 55 and 58, each having a first inner curved longitudinal edge 56 and a second outer curved longitudinal edge 57. Two integral connector strips 59 and 60 extend transversely between major sheet sections 55 and 58.

Figure 7:
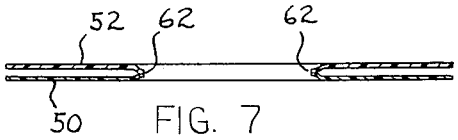
Figure 8:
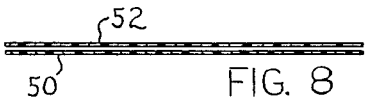
Figure 9:
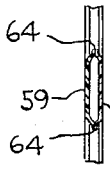

Sheets 50 and 52 are shown superimposed, one of the other, after which the opposed inner curved edges 56 are stamp-welded together, as at 62. The stamp-weld process is continued along side edge areas of connector strips 59 and 60, as at 64. FIGS. 7 and 9 are cross-sectional views of the two sheets and the references stamp welds 62 and 64. The face areas of the sheets are shown spaced slightly apart to better illustrate the stamp weld seam joints between the sheets.

With sheets 50 and 52 stamp-welded at their inner edges, the longitudinal sheet sections 55 and 58 are turned inside out (around longitudinal axis 53) to the condition shown in FIG. 10. This brings the outer longitudinal edges 57 of the sheet sections together. The confronting edges 57 are stamp-welded together, as at 66, to form the hollow balloon body 12 (FIG. 1). The stamp-weld process is performed along the entire length of the seam defined by curved edges 57.

Figure 4:
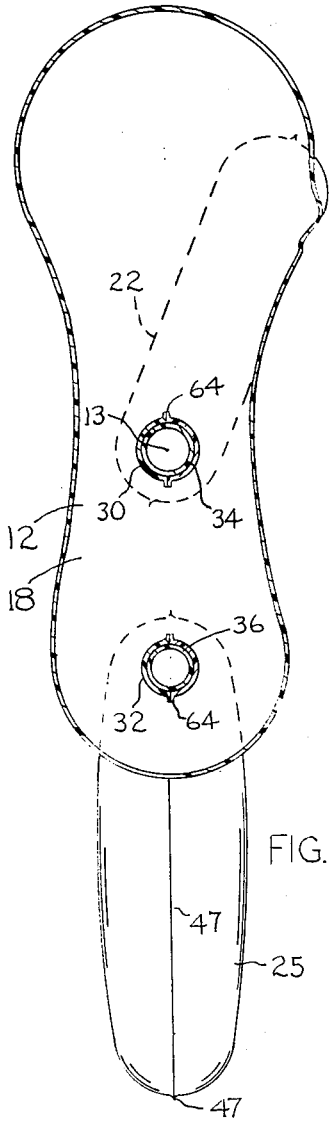
Figure 6:
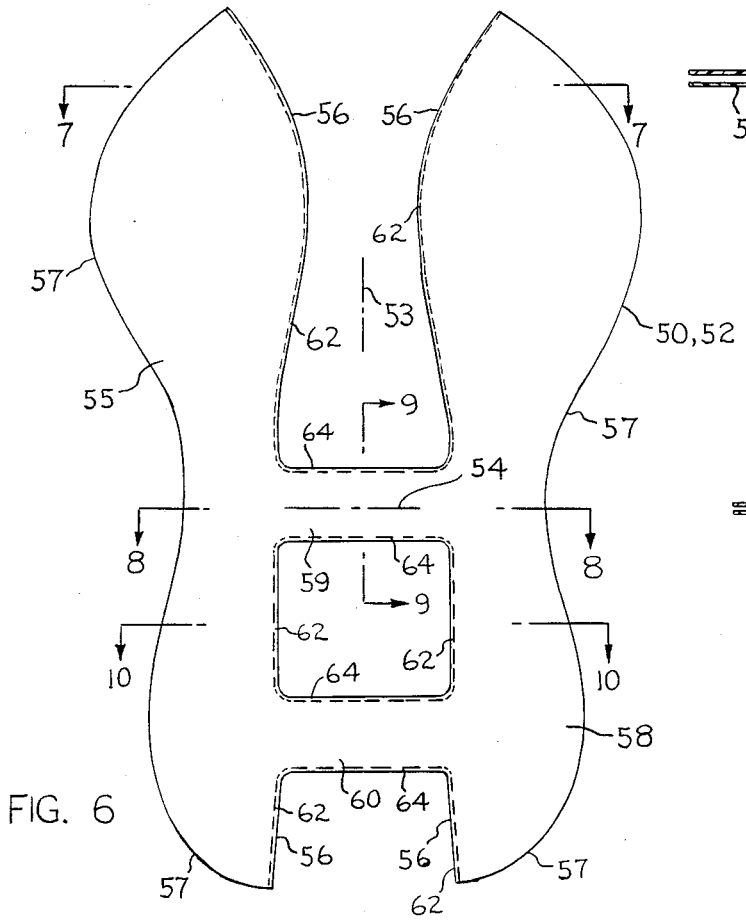

The confronting connector strips 59 form the aforementioned tubular sleeve 30 (FIG. 1). The confronting connector strips 60 (FIG. 6) form the aforementioned tubular sleeve 32 (FIG. 1). The two sleeves 30 and 32 extend transversely through hollow body 12, i.e. parallel to transverse axis 54 (FIG. 6). When body 12 and the associated hollow bodies 14 and 16 are inflated the assembly assumes the three dimensional configuration shown in FIG. 1. Air pressure forces cause the concentric sleeve 30, 32 and flexible pipes 34, and 36 to have the circular cross sectional shapes shown in FIG. 4.

A primary feature of the invention is the frictional interengagement between sleeves 30, 32 and flexible pipes 34, 36, whereby the various simulated limbs 22, 23, 25 and 27 can be selectively swingably adjusted the different positions.

The drawings shown one configuration and structural arrangement that can be used in practicing the invention. Other forms and arrangements can be utilized.

I claim:

1. An inflatable three dimensional figure comprising:

a main hollow balloon body formed by two individual flat flexible sheets, each sheet having a longitudinal direction and a transverse direction;

each sheet comprising two longitudinally-extending major sheet sections spaced apart in the transverse direction, and at least one connector strip extending transversely between the spaced-apart sections; each sheet section having a first curved longitudinal edge and second curved longitudinal edge; said sheets being aligned so that the first longitudinal edges of the major sheet sections on different sheets are joined together to form a flanged seam, each said flanged seam being continued along side edges of the associated connector strips so that the connector strips form a tubular wall; the sheet sections in each of the sheets being turned inside out so that the associated flanged seam is within the space encompassed by the sheets; the second longitudinal edges of aligned sheet sections being joined together to form two longitudinal flanged seams; and at least one hollow limb body;

each hollow limb body including a hollow flexible pipe frictionally fitting within the aforementioned tubular wall, and a hollow bulging limb extending angularly from each end of the flexible pipe, to thereby enable each building limb to assume different angulations relative to the tube axis.

2. The three dimensional figure of claim 1 wherein there are two connector strips in each sheet; said connector strips being longitudinally spaced from each other, whereby the main balloon body has two tubular walls extending transversely therethrough; and a hollow limb body associated with each tubular wall.

It is now believed that the application has been placed in a state of allowance and such allowance is courteously solicited.

* * * * *